US012455146B1

(12) United States Patent
Blauer

(10) Patent No.: US 12,455,146 B1
(45) Date of Patent: Oct. 28, 2025

(54) NECK PROTECTING SOFT BODY ARMOR PANEL

(71) Applicant: Blauer Manufacturing Company, Inc., Boston, MA (US)

(72) Inventor: Stephen J Blauer, Lexington, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 0 days.

(21) Appl. No.: 19/230,700

(22) Filed: Jun. 6, 2025

Related U.S. Application Data

(63) Continuation of application No. 19/044,866, filed on Feb. 4, 2025, now Pat. No. 12,372,334.

(51) Int. Cl.
*F41H 5/04* (2006.01)

(52) U.S. Cl.
CPC ..... *F41H 5/0478* (2013.01)

(58) Field of Classification Search
CPC ..... F41H 5/0478
USPC ..... 89/36.02
See application file for complete search history.

(56) References Cited

U.S. PATENT DOCUMENTS 3,973,275 A 8/1976 Blauer
4,079,464 A * 3/1978 Roggin ..... F41H 1/02 2/2.5
4,574,105 A 3/1986 Donovan
6,098,196 A * 8/2000 Logan ..... F41H 1/02 2/2.5
2014/0216240 A1* 8/2014 Hellweg ..... B63C 9/1255 441/90
2015/0247705 A1* 9/2015 Martinez ..... A41D 13/0153 2/2.5
2016/0040962 A1* 2/2016 Rossow ..... B32B 5/06 89/36.02
2016/0128394 A1* 5/2016 Kohrman ..... A45F 3/14 2/102
2020/0200510 A1* 6/2020 Bessey ..... B32B 5/06
2021/0116218 A1* 4/2021 Nuss ..... B65D 75/5888
2022/0244021 A1* 8/2022 Malone ..... F41H 5/013
2024/0183639 A1 6/2024 Tunis, III et al.

FOREIGN PATENT DOCUMENTS

BE 1021642 B1 12/2015
WO WO-9922195 A1 * 5/1999 ..... F41H 5/0435
WO WO-2009005548 A2 * 1/2009 ..... F41H 5/0485

* cited by examiner

*Primary Examiner* — Samir Abdosh
(74) *Attorney, Agent, or Firm* — Altman & Martin; Steven K Martin

(57) ABSTRACT

A soft body armor panel where one or more layers are folded over as an apron at the top edge forming a pocket(s) centered on the top edge that captures a bullet directed upwardly. The folded layers can take any number of different configurations. The folded layers can be stacked or nested. Normal layers can separate folded layers and/or be within pockets of folded layers. The apron can be 1-20 inches or extend the full height of the layer.

10 Claims, 5 Drawing Sheets

NECK PROTECTING SOFT BODY ARMOR PANEL

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to body armor, more particularly, to body armor panels that protect the wearer's neck area.

2. Description of the Related Art

Current soft body armor panels are built in multiple layers, typically 20-50 layers, of woven aramid or a combination of woven aramid and high-density aramid or high-density polyethylene unidirectional materials. To construct a panel, the layers are stacked as desired, stitched together, placed in a waterproof cover, and sealed. The edges of the layers are typically unfinished and may be held together before covering with masking tape.

This typical construction, which has been used for several years, creates challenges when subjected to the test firing protocol of the latest National Institute of Justice (NIJ) Standard 0101.07 requirements. The latest standard includes an additional shot (#7), which is a 45-degree upward angle shot directly under the neck of the wearer. The energy of this ballistic test can cause the bullet to travel upwardly in the panel and possibly exit on the top edge, causing damage to the wearer's face, neck, and/or chest. Current solutions involve perimeter stitching the layers, strategic bar tacks, back tack, or zigzag type stitches to stabilize the woven aramid materials on the strike face in an attempt to encapsulate the bullet and prevent complete penetration.

Recent ballistic testing, both before and after laboratory conditioning of the panels, suggests that current solutions are insufficient to fully encapsulate. 357 Magnum jacketed soft point (JSP) 158 grain (gr), .44 Magnum jacketed hollow point (JHP) 240 gr, and 9 mm 124 gr full metal jacket (FMJ) bullets. The .357 Magnum and .44 Magnum bullets are hollow point designs and tend to petal upon impact, with the shards created by the impact grabbing the ballistic materials. However, the full metal jacket design of the 9 mm 124 gr FMJ bullet penetrates layers and flattens and slides along the ballistic materials upon impact, making it more difficult to fully encapsulate within the armor panel.

Also, both Magnum bullets, being larger, are targeted 1" farther from the edge of the panel than the FMJ bullet, which allows the hollow point Magnums to petal and more easily grab and stick in the strike face. Test data so far shows shot #7 with 9 mm FMJ can penetrate several layers, skid along the panel, break the stitching, and escape along the top edge, resulting in failure. Preliminary test results on conditioned panels, which are subjected to 10 days of tumbling (72,000 rotations+−1500) at 149° F., per ASTM E3005, are more likely to fail against all three projectiles, as it appears tumbling loosens the layers behind the strike face and may also negatively impact the stitching along the neckline used to secure the layers and grab the projectiles.

BRIEF SUMMARY OF THE INVENTION

The present invention is a soft body armor panel where one or more of the layers are folded over at the top edge forming a pocket(s) that can capture a bullet that is directed upwardly. There are a number of different configurations contemplated for the folded and non-folded layers.

In one configuration, an apron of a single folded layer extends 1 to 20 inches toward the bottom edge to form the pocket. The pocket is at least 3 inches wide, centered on the top edge. When there is a neck scoop, the pocket is centered on the neck scoop.

In another configuration, more than one layer is folded over to form pockets. The layers can be stacked together or separated by normal layer(s). In another configuration, several layers are folded over and the pockets are nested. In another configuration, one or more normal (non-folded) layers extend into the pocket. In another configuration, several folded layers are nested and one or more normal layers extend into the innermost pocket. In another configuration, several folded layers are nested and one or more normal layers extend into each of the nested pockets.

In the above configurations, the normal layers and folded layer(s) are stacked so that the pockets are at or near the strike face.

In another configuration, all of the normal layers extend into the pocket. In another configuration, all of the normal layers extend into the innermost of nested pockets.

The fold can be toward the strike face or away from the strike face.

Rather than the apron extending 1-20 inches toward the bottom edge, the apron extends to the bottom edge.

Because the neck scoop is curved, the shape of the fold is formed into the folded layer as the folded layer is produced by methods well known in the art.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. patent application Ser. No. 19/044,866, of which the present application is a continuation application.

Figure 1:
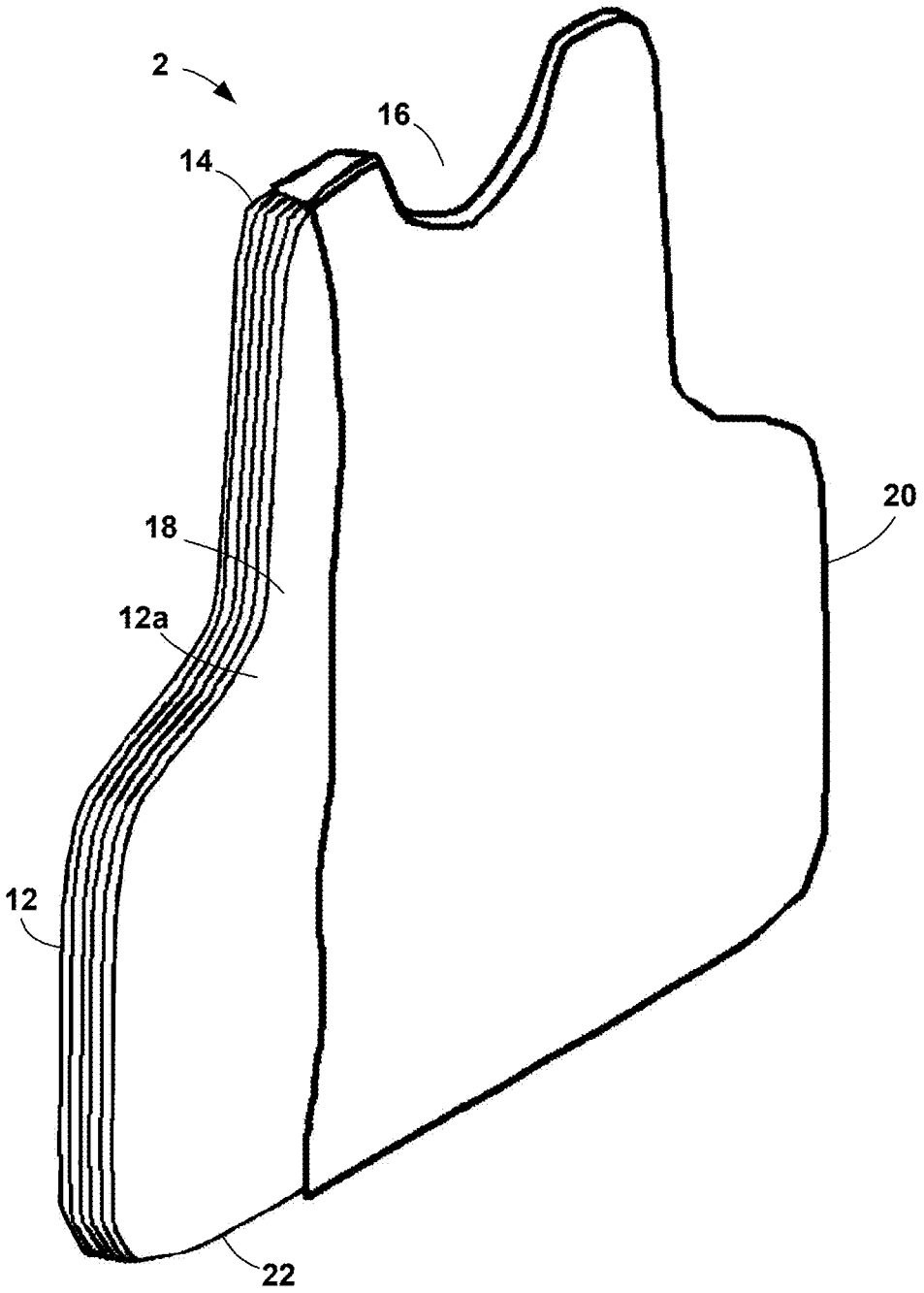
FIG. 1 Prior Art
FIG. 1 is a cutaway of a prior art soft body armor panel.

Soft body armor is comprised of at least two panels: a front panel and a rear panel. Each panel is composed of up to fifty layers 12 of ballistic material, typically around thirty. A front panel 2, shown in FIG. 1, has a bottom edge 22 and a top edge 14 with a scoop 16 for the wearer's neck. A rear panel (not shown) is of the same construction but without a pronounced neck scoop 16. The outer surface of the outer layer 12*a* is the strike face 18. The layers 12 are encapsulated in a waterproof cover 20.

The present invention is a soft body armor panel 10 where one or more of the layers 30 are folded over at the top edge 14, as at 32, to form an apron 36 that extends toward the bottom edge 22. Folding over the layer 30 forms a pocket 34 that can capture a bullet that is directed upwardly, either by deflection or by intent.

The folded layer(s) 30 are single or plied woven aramid and/or high-density aramid or high-density polyethylene unidirectional materials, referred to hereinafter as ballistic materials. The folded layer(s) 30 provides sufficient ballistic materials at the top edge 14 to effectively capture .357 Magnum JSP 158 gr, .44 Magnum JHP 240 gr, and 9 mm 124 gr FMJ bullets and prevent complete penetration and failure.

The present invention contemplates a number of different configurations for the layers 12/30, shown in FIGS. 2-13. In these figures, the number of layers 12/20 illustrated is kept to a minimum so that the particular configuration is clearly shown. The actual number of layers 12/20 will depend on the particular materials and application.

Figure 2:
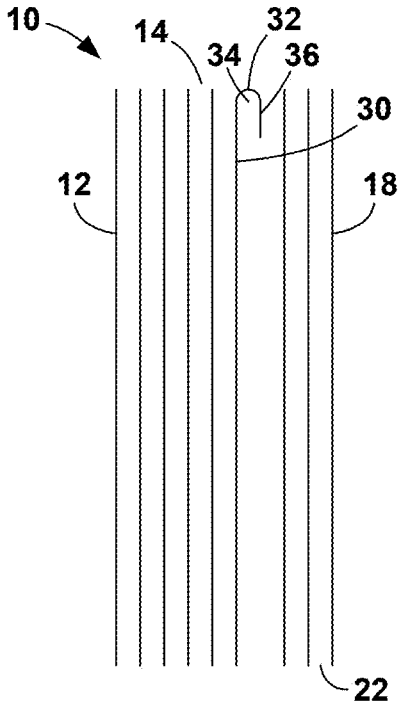
FIG. 2 is a side view of a panel configuration with a single pocket where the fold is toward the strike face.
Figure 3:
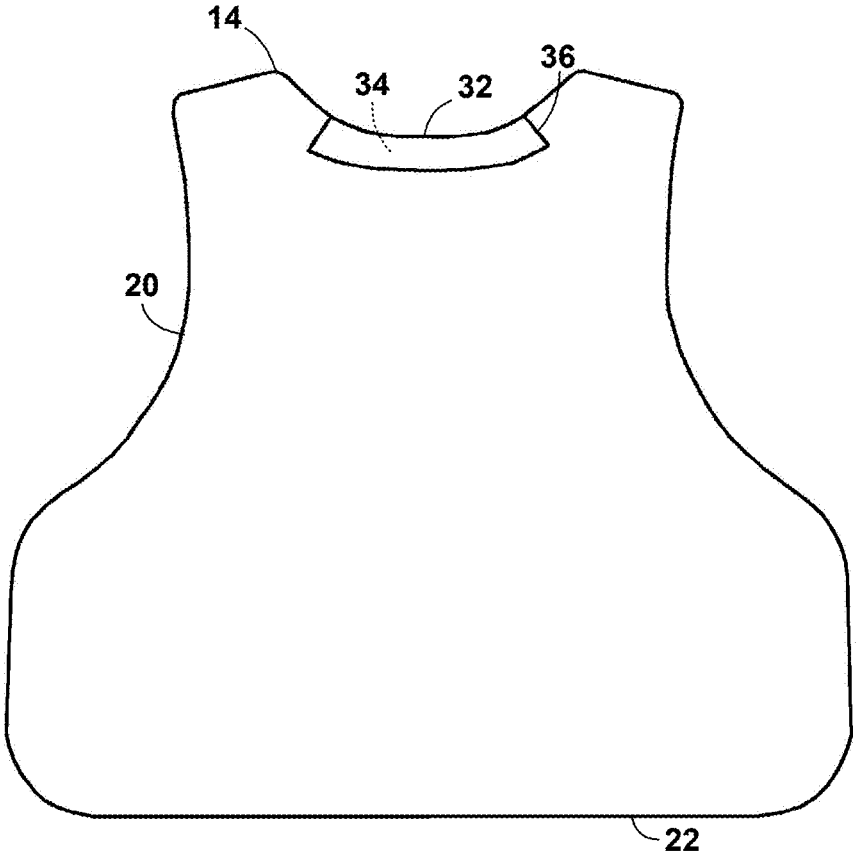
FIG. 3 is a front view of a folded layer where the fold is toward the strike face.

In one configuration, shown in FIGS. 2 and 3, the apron 36 extends 1 to 20 inches toward the bottom edge 22 to form the pocket 34. The apron 36 (and hence the pocket 34) is at least 3 inches wide, centered on the top edge 14, and may be up to as wide as the panel 10. When there is a neck scoop 16, the apron 36 is centered on the neck scoop 16.

Figure 4:
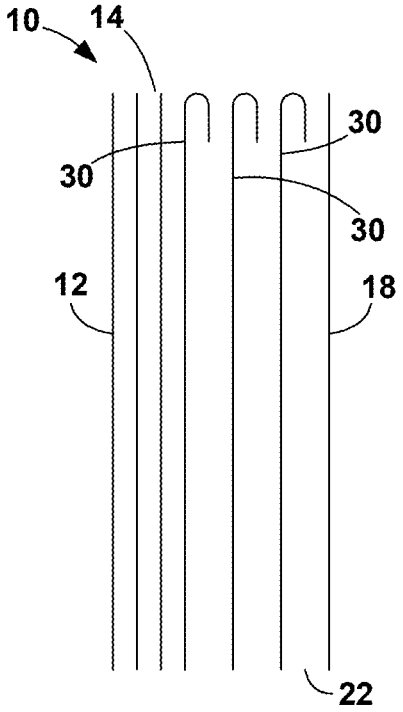
FIG. 4 is a side view of a configuration with pockets stacked together.
Figure 5:
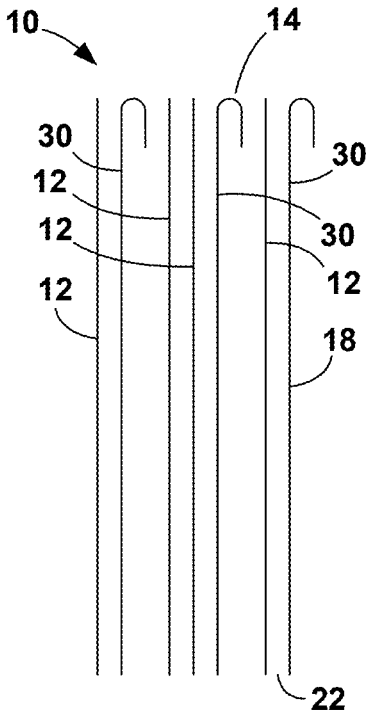
FIG. 5 is a side view of a configuration with pockets separated by normal layers.

In another configuration, an example of which is shown in FIG. 4, more than one layer 30 is folded over to form pockets 34. In FIG. 4, three layers 30 are folded over and are stacked together. The present invention contemplates that any number of layers 30 can be folded over and the folded over layers 30 do not have to be stacked together; they can be separated by one or more normal (non-folded) layers 12, as in the example of FIG. 5.

Figure 6:
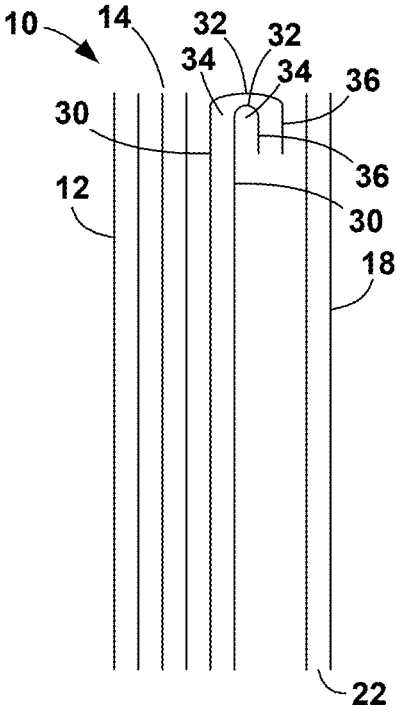
FIG. 6 is a side view of a configuration with nested pockets.

In another configuration, an example of which is shown in FIG. 6, several layers 30 are folded over and nested to provide more than one layer of protection at the top edge 14. Any number of layers 30 can be nested in this way.

Figure 7:
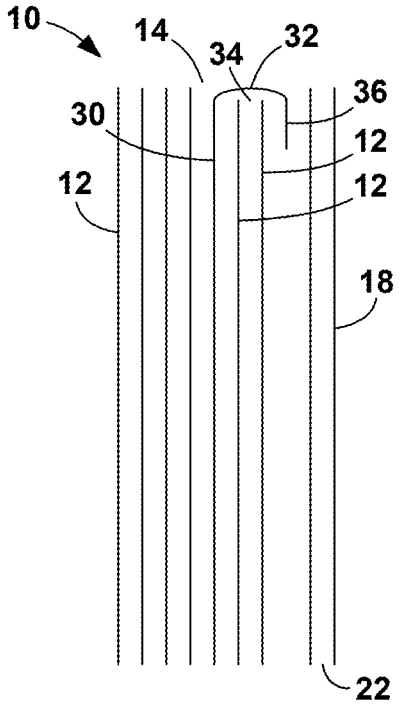
FIG. 7 is a side view of a configuration with a filled pocket.

In another configuration, an example of which is shown in FIG. 7, a layer 30 is folded over and one or more normal layers 12 extend into the pocket 34.

Figure 8:
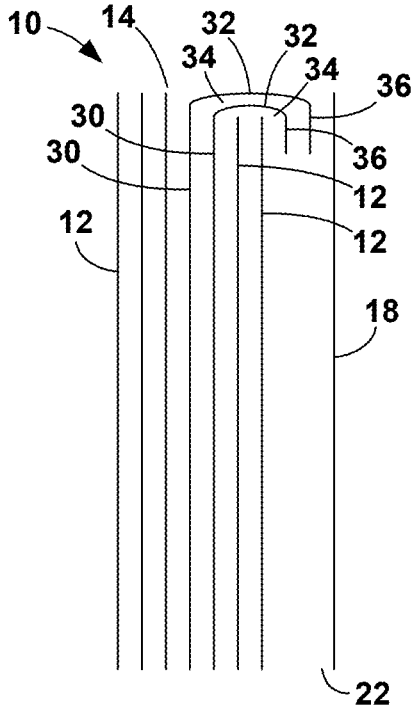
FIG. 8 is a side view of a configuration with nested filled pockets.

Another configuration, an example of which is shown in FIG. 8, is a combination of the configurations of FIGS. 6 and 7. Several folded layers 30 are nested and one or more normal layers 12 extend into the innermost of the nested pockets 34.

Figure 9:
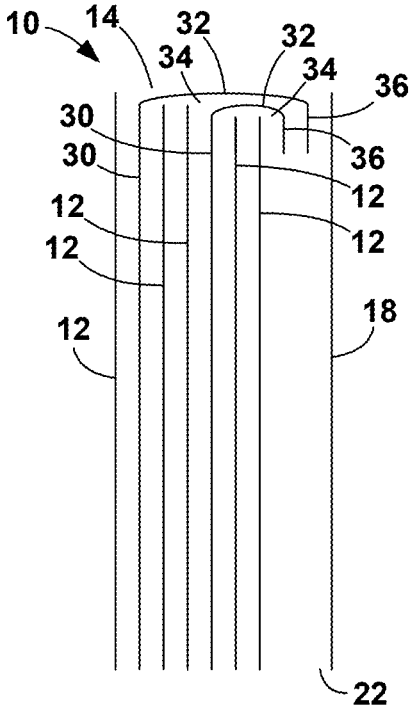
FIG. 9 is a side view of a configuration with nested filled pockets.

Another configuration, an example of which is shown in FIG. 9, is a different combination of the configurations of FIGS. 6 and 7. Several folded layers 30 are nested, one or more normal layers 12 extend into each of the nested pockets 34.

Tests show that bullets in shot #7 do not penetrate far into the panel. Consequently, in the configurations of FIGS. 2-9, the normal layers 12 and folded layer(s) 30 will be stacked so that the pockets 34 are at or near the strike face 18, for example, within the first ten layers.

Figure 10:
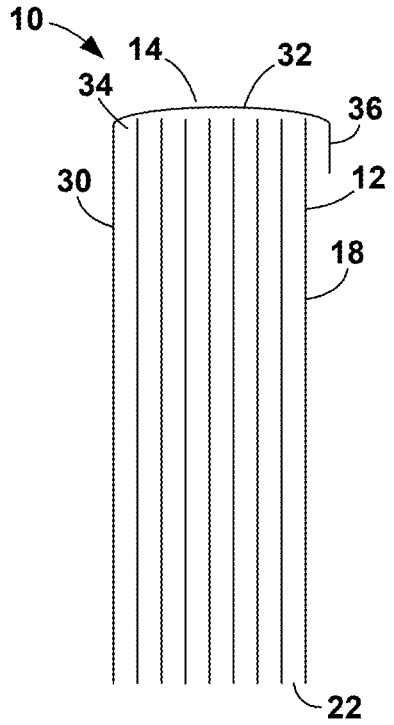
FIG. 10 is a side view of a configuration with a fully filled pocket.

The configuration of FIG. 10 is a special case of FIG. 7, where all of the normal layers 12 extend into the pocket 34.

Figure 11:
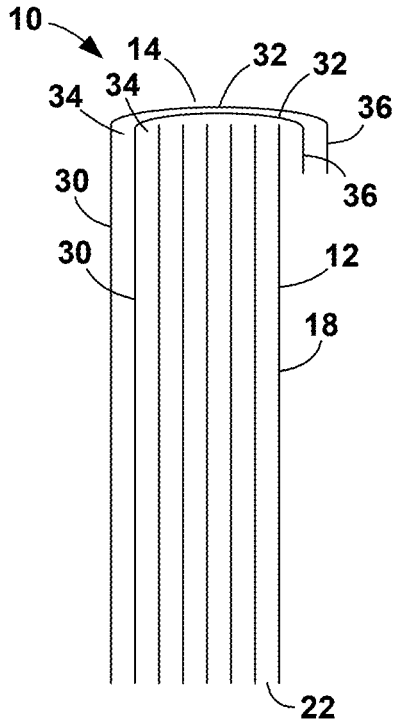
FIG. 11 is a side view of a configuration with nested fully filled pockets.

The configuration of FIG. 11 is a special case of FIG. 8, where all of the normal layers 12 extend into the innermost of the nested pockets 34.

The above-described configurations are merely several of the configurations that can be employed. Any configuration of folded layers 30 and normal layers 12 are contemplated by the present invention, including various combinations of the above-described configurations.

Figure 12:
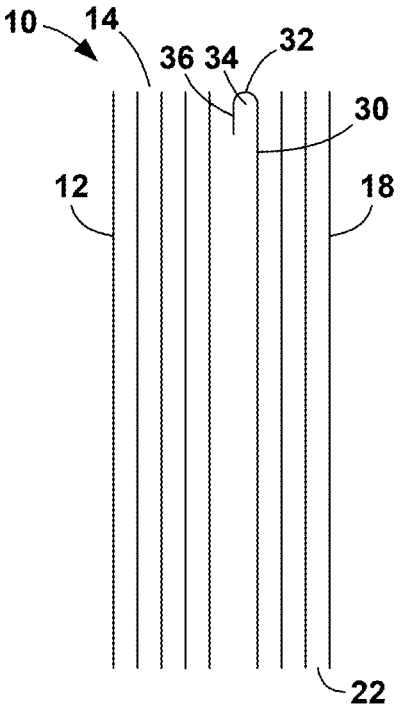
FIG. 12 is a side view of a panel configuration with a single pocket where the fold is away from the strike face.

The fold 32 can be in either direction: toward the strike face 18, as in FIGS. 2-11, or away from the strike face 18, as in FIG. 12. If the folded layer 30 is the strike face 18, having the apron 36 in front of the strike face 18 is preferred. In the configurations of FIGS. 9 and 10, if the bullet should hit the strike face 18 but not penetrate and merely ride along the strike face 18, a pocket 34 formed by an apron 36 behind the strike face 18 would not capture the bullet.

Figure 13:
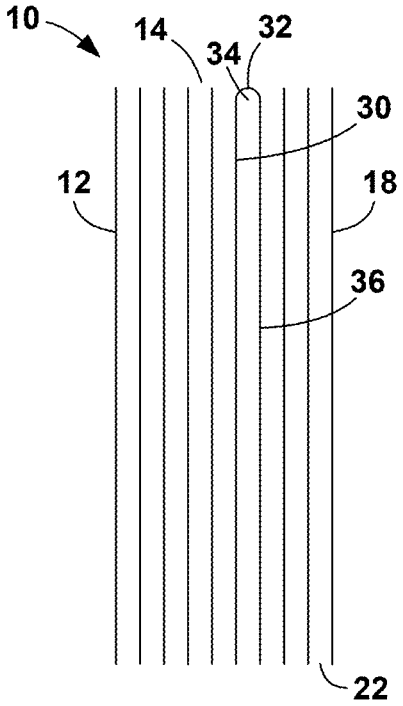
FIG. 13 is a side view of a single pocket configuration of the panel of the present invention where the fold is between two mirror image layers.

Alternatively, the apron 36 extends to the bottom edge 22, that is, the apron 36 is the full height of the layer 30, as in FIG. 13. In other words, each folded layer 30 is comprised of two mirror image layers continuous at the top edge 14 and folded.

Because the neck scoop 16 is curved, not straight, the folded layers 30 in a front panel 10 cannot be made flat and merely folded over. The shape of the fold 32 is formed into the folded layer 30 as the folded layer 30 is produced by methods well known in the art.

As with prior art panels, the panel 10 of the present invention can be either perimeter stitched, strategically bar tacked, back tacked, or zigzag stitched along the top edge 14. The pocket(s) 34 improve the ability of the panel 10 to withstand tumble conditioning and still prevent complete penetration, even if the stitching is negatively affected by the heat and rotation of the tumble test.

Thus, it has been shown and described a neck protecting soft body armor panel. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. A soft armor panel comprising a plurality of layers of ballistic materials within a cover and having a top edge and a bottom edge with at least one layer folded over to form a pocket at the top edge, wherein the top edge has a neck scoop.

2. The soft armor panel of claim 1 wherein the pocket is centered on the top edge.

3. The soft armor panel of claim 1 wherein the pocket is centered on the neck scoop.

4. The soft armor panel of claim 1 wherein a plurality of layers are folded over.

5. The soft armor panel of claim 4 wherein at least two of the pockets are nested.

6. The soft armor panel of claim 5 wherein all of the layers except the folded layers are within the inner most nested pocket.

7. The soft armor panel of claim 1 wherein at least one layer is within the pocket.

8. The soft armor panel of claim 1 wherein all layers except the folded layers are within a pocket.

9. The soft armor panel of claim 1 wherein an apron formed by folding over the layer extends toward the bottom edge by 1 to 20 inches.

10. The soft armor panel of claim 1 wherein an apron formed by folding over the layer extends to the bottom edge.

* * * * *